US007357495B2

(12) United States Patent
Matsumoto

(10) Patent No.: US 7,357,495 B2
(45) Date of Patent: Apr. 15, 2008

(54) LIQUID CONTAINER WITH INTERNAL LIQUID PACK

(75) Inventor: Hitoshi Matsumoto, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 323 days.

(21) Appl. No.: 11/075,288

(22) Filed: Mar. 8, 2005

(65) Prior Publication Data

US 2005/0243149 A1 Nov. 3, 2005

(30) Foreign Application Priority Data

Mar. 10, 2004 (JP) ..... 2004-067869

(51) Int. Cl.
*B41J 2/175* (2006.01)
*B41J 2/17* (2006.01)

(52) U.S. Cl. ..... 347/86; 347/84

(58) Field of Classification Search ..... 347/86, 347/84

See application file for complete search history.

(56) References Cited

U.S. PATENT DOCUMENTS

| | | | | |
|---|---|---|---|---|
| 6,220,702 | B1 | 4/2001 | Nakamura et al. | |
| 6,758,556 | B2 | 7/2004 | Ishizawa et al. | |
| 2001/0024225 | A1* | 9/2001 | Ishizawa et al. | 347/86 |
| 2003/0142181 | A1* | 7/2003 | Sugata | 347/86 |

FOREIGN PATENT DOCUMENTS

| | | | | |
|---|---|---|---|---|
| CN | 1319502 | A | | 10/2001 |
| JP | 58-108154 | A | | 6/1983 |
| JP | 60-064846 | U | | 5/1985 |
| JP | 60-217159 | A | | 10/1985 |
| JP | 60-240456 | A | | 11/1985 |
| JP | 62021549 | A | * | 1/1987 |
| JP | 62204951 | A | * | 9/1987 |

OTHER PUBLICATIONS

Chinese Office Action from CN 200510053714.X (Dec. 22, 2006) (w/ partial English translation).

* cited by examiner

*Primary Examiner*—Stephen Meier
*Assistant Examiner*—Carlos A. Martinez, Jr.
(74) *Attorney, Agent, or Firm*—Stroock & Stroock & Lavan LLP

(57) ABSTRACT

A liquid container includes a liquid pack having a flexile pouch holding liquid, the flexible pouch having a bent wall which bends with a consumption of the liquid held in the flexible pouch; a container body containing the liquid pack; and a restricting member to be in contact with the bent wall of the flexible pouch for restricting the bent wall of the flexible pouch from bending outward while the liquid is consumed. The restricting member is in contact with the bent wall over substantially the entire thickness of the flexible pouch of the liquid pack. When the flexible pouch of the liquid pack is compressed to discharge the liquid, the bent wall of the flexible pouch of the liquid pack can be surely prevented from bending outward, without any breakage of the flexible pouch.

12 Claims, 13 Drawing Sheets

LIQUID CONTAINER WITH INTERNAL LIQUID PACK

CROSS REFERENCE TO RELATED APPLICATIONS

This application is based upon and claims the benefit of priority from the prior Japanese Patent Application No. 2004-67869, the entire contents of which are incorporated herein by reference.

BACKGROUND OF THE INVENTION

1. Technical Field

The present invention relates to a liquid container for holding a liquid to be supplied to a liquid-consuming apparatus.

2. Description of the Related Art

A liquid-ejecting apparatus provided with an ejecting head that ejects a liquid is a representative conventional liquid-consuming apparatus. An ink-jet recording apparatus provided with an ink-jet recording head for recording images is a typical example of the liquid-ejecting apparatus. Other examples of the liquid-ejecting apparatus are an apparatus provided with a coloring matter ejecting head for fabricating color filters for liquid crystal displays, an apparatus provided with an electrode forming material (conductive paste) ejecting head for forming electrodes for organic EL displays and field emission displays (FEDs), an apparatus provided with a bioorganic material ejecting head for manufacturing biochips, and an apparatus provided with a sample ejecting head as a precision pipette.

The ink-jet recording apparatus, which is a representative liquid-ejecting apparatus, is used prevalently nowadays for printing operations including color printing operations, because the ink-jet recording apparatus generates comparatively low noise during a printing operation and is capable of forming small dots in a high dot density.

A liquid supply system for supplying a liquid to the liquid-consuming apparatus represented by the ink-jet recording apparatus supplies the liquid from a liquid container holding the liquid to the liquid-consuming apparatus. Generally, the liquid container used by the liquid supply system is a cartridge capable of detachably attached to the liquid-consuming apparatus to facilitate the user's works for replacing the liquid container with a new one when the liquid contained in the liquid container is exhausted.

Generally, the ink-jet recording apparatus is provided with a carriage carrying a recording head that ejects ink drops, and is capable of reciprocating along the recording surface of a recording medium. An ink supply system for supplying ink from an ink cartridge to a recording head mounts the ink cartridge on a carriage and supplies the ink from the ink cartridge to a recording head while the ink cartridge is reciprocated together with the recording head. Another ink supply system mounts an ink cartridge on the case or the like of the body of an apparatus, and carries ink from the ink cartridge to a recording head by a flexible tube or the like forming an ink passage.

In some conventional ink cartridges, an ink pack having a flexible pouch containing ink therein is accommodated in a container body formed of a rigid material. There are various kinds of flexible pouches. A flexible pouch of one type is formed by merely attaching two film members to each other at peripheries thereof, while a flexible pouch of another type is formed by using an additional pair of film members extending along the thickness direction of the ink pack to form four side surfaces of the flexible pouch. The ink pack of the latter type, which is a so-called gazette-type ink pack, is suitable for containing an increased quantity of the ink.

As the ink contained in the gazette-type ink pack is consumed, the film members extending along the thickness direction of the flexible pouch bend. When the film member bends to project outward, problems occur in that a resistance against the bending of the film member increases, and a quantity of the ink, which is unused and remains in the ink pack, will increase.

JP-A 60-217159 (Patent document 1) proposes a restricting frame to be fitted in a fold formed in a side surface of an ink containing pouch.

However, in the constitution disclosed in Patent document 1, the restricting frame is brought into linear contact with the fold of the ink containing pouch along a folding line of the fold. Thus, in applying the constitution described in Patent document 1 to an ink cartridge which discharges ink by compressing an ink containing pouch, when the ink containing pouch is pressed, the restricting frame in linear contact with the fold formed in the side surface of the ink containing pouch presses the fold along the folding line thereof. Since impulsive forces are applied intensively to the folding line of the side surface of the ink containing pouch, the ink containing pouch may be broken along the folding line.

Further, the constitution described in Patent document 1 has another disadvantage in that, since a restricting part is movably disposed in a container body, the restricting frame cannot serve as a securing means for securely holding the ink containing pouch in place in the container body.

SUMMARY OF THE INVENTION

The present invention has been made in view of the foregoing problems, and it is therefore an object of the present invention to provide a liquid container provided with a liquid pack including a flexible pouch with a bent wall which bends with a consumption of liquid, in which, when the flexible pouch of the liquid pack is pressed to discharge a liquid, the bent wall of the flexible pouch of the liquid pack can surely be prevented from bending outward when the liquid is consumed, without any breakage of the flexible pouch.

Another object of the present invention is to provide a liquid container in which a liquid pack can be secured in position in a container body of the liquid container.

To solve the problems, the present invention provides a liquid container holding a liquid to be supplied to a liquid-consuming apparatus, including: a liquid pack including a flexible pouch formed of a flexible material and holding the liquid, the flexible pouch having a bent wall which bends with a consumption of the liquid held in the flexible pouch; a container body containing the liquid pack; and a restricting member configured to be in contact with the bent wall of the flexible pouch for restricting the bent wall of the flexible pouch from bending outward when the liquid is consumed; wherein the restricting member is adapted to be in contact with the bent wall over substantially an entire thickness of the flexible pouch of the liquid pack.

Preferably, the restricting member has a width substantially corresponding to an entire thickness of an interior space in the container body.

Preferably, the restricting member is configured to be in contact with the bent wall of the flexible pouch such that the bent wall bends inward when the liquid is consumed.

Preferably, the restricting member has a length substantially corresponding to an overall length of the flexible pouch of the liquid pack in a back-and-forth direction.

Preferably, the restricting member includes a plurality of restricting members which are disposed at intervals along a length of the flexible pouch of the liquid pack in a back-and-forth direction.

Preferably, the restricting member includes a rib configured to be in linear contact with the bent wall along the thickness of the flexible pouch of the liquid pack.

Preferably, the restricting member includes a transverse contact part configured to be in contact with the bent wall over substantially the entire thickness of the flexible pouch of the liquid pack, and a longitudinal contact part configured to be in linear contact with the bent wall along a length of the flexible pouch of the liquid pack in a back-and-forth direction.

Preferably, the restricting member has a substantially triangular cross section projecting toward the bent wall of the flexible pouch.

Preferably, the liquid container further includes a holding member for securing the liquid pack in the container body, wherein the restricting member is formed integrally with the holding member.

Preferably, the restricting member is formed integrally with the container body.

Preferably, the container body includes a main member having an open front end, and a cover hermetically covering the open front end of the main member.

Preferably, the liquid is discharged by compressing the flexible pouch of the liquid pack by pressure of a pressurized fluid supplied into the container body.

Preferably, the liquid container further includes an expandable-and-contractile stirring chamber formed in the container body. Pressurized fluid is supplied into the stirring chamber to expand the stirring chamber so that the flexible pouch of the liquid pack is pressed and deformed to stir the liquid contained in the liquid pack.

The present invention characterized by the foregoing description provides a liquid container provided with a liquid pack including a flexible pouch with a bent wall which bends with a consumption of the liquid, in which, when the flexible pouch of the liquid pack is pressed to discharge a liquid, the bent wall of the flexible pouch of the liquid pack can surely be prevented from bending outward when the liquid is consumed, without any breakage of the flexible pouch.

In addition, according to the present invention, the liquid pack can be secured in position in a container body of the liquid container.

BRIEF DESCRIPTION OF THE DRAWINGS

The above and other objects, features and advantages of the present invention will become apparent from the following description taken in connection with the accompanying drawings, in which.

DETAILED DESCRIPTION OF THE INVENTION

An ink cartridge, namely, a liquid container, for an ink-jet recording apparatus in a preferred embodiment according to the present invention will be described with reference to the accompanying drawings.

First, an ink-jet recording apparatus provided with the ink cartridge embodying the present invention will be described with reference to FIG. 1.

Figure 1:
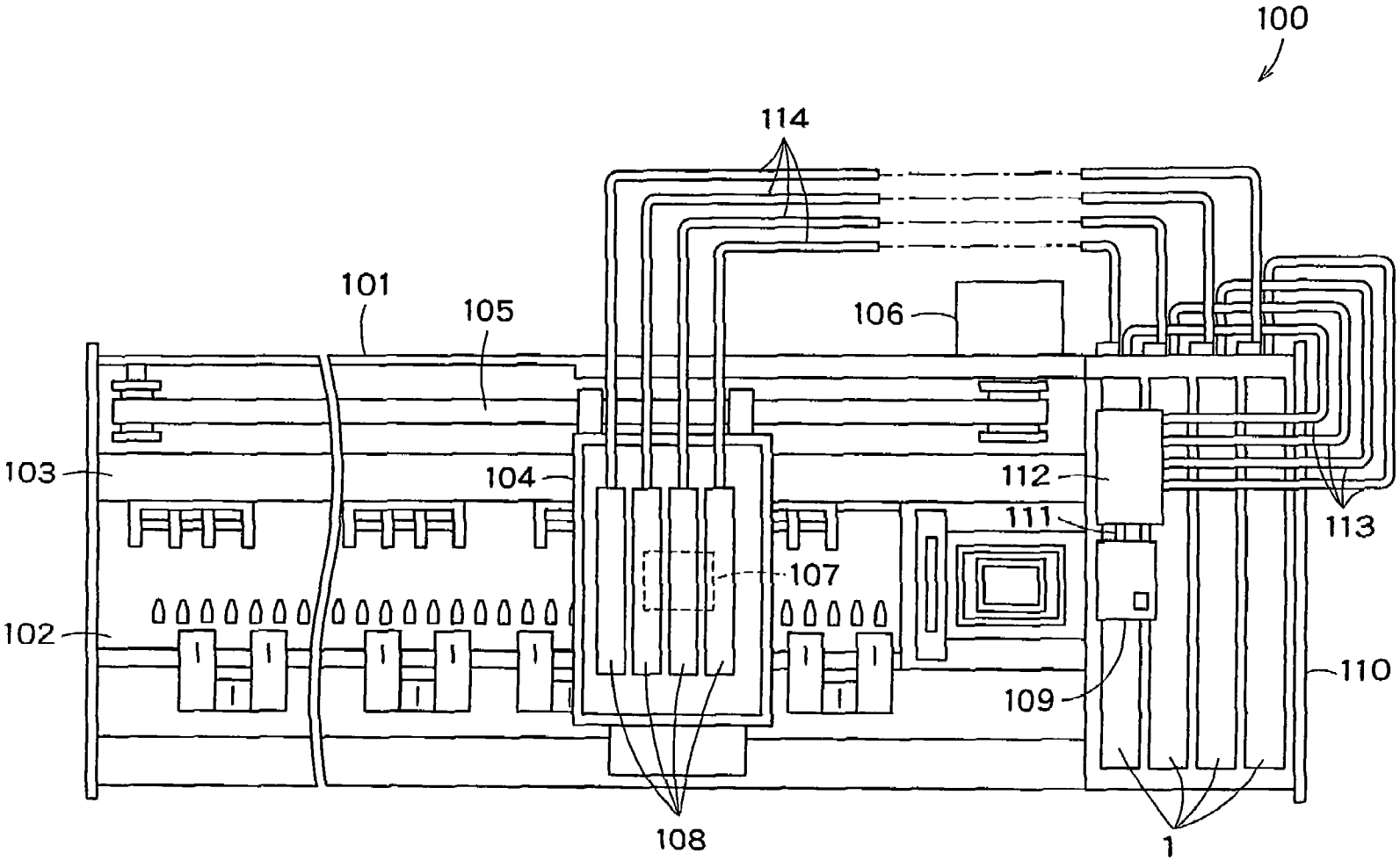
FIG. 1 is a plan view of an ink-jet recording apparatus provided with an ink cartridge in a preferred embodiment according to the present invention.

Referring to FIG. 1, an ink-jet recording apparatus 100 has a main case 101, a platen 102, a guide rod 103, a carriage 104, a timing belt 105, a carriage driving motor 106, and a recording head 107, namely, a liquid ejecting head. The ink-jet recording apparatus 100 is provided with valve units 108 and a pressurizing pump 109.

The main case 101 is a box of a shape substantially resembling a rectangular solid. The main case 101 is provided with a cartridge holder 110 in a right end part, as viewed in FIG. 1, thereof. Four ink cartridges 1, namely, liquid containers, in a preferred embodiment according to the present invention, are detachably mounted on the cartridge holder 110. The four ink cartridges 1 contain a black ink, a yellow ink, a magenta ink, and a cyan ink, respectively.

The platen 102 is extended parallel to a scanning direction in which the recording head 107 moves in the main case 101.

The platen 102 supports a recording medium, not shown, fed by a paper feed means, not shown. The recording medium is fed in a feed direction perpendicular to the scanning direction.

The guide rod 103 having the shape of a bar is extended parallel to the scanning direction parallel to the platen 102 in the main case 101. The guide rod 103 penetrates the carriage 104 so that the carriage 104 is slidable on the guide rod 103 to guide the carriage 104 disposed opposite to the platen 102 for reciprocation in directions parallel to the scanning direction.

The carriage driving motor 106 is interlocked with the carriage 104 by the timing belt 105. The carriage driving motor 106 is supported on the main case 101. The carriage driving motor 106 operates to drive the carriage 104 through the timing belt 105 for reciprocation along the guide rod 103 in directions parallel to the scanning direction.

The recording head 107 is provided with a plurality of nozzles to eject ink drops toward the platen 102. The valve units 108 are mounted on the carriage 104. The valve units 108 hold the inks temporarily, adjust the pressures of the inks, and supply the inks of adjusted pressures to the recording head 107. This ink-jet recording apparatus 100 is provided with four valve units 108 respectively for the black ink, the yellow ink, the magenta ink, and the cyan ink.

The pressurizing pump 109 is connected to a pressure measuring device 112 by a connecting tube 111. Air supply tubes 113 connect the pressure measuring device 112 to the ink cartridges 1, respectively. The ink cartridges 1 are connected to the valve units 108 by ink supply tubes 114, respectively.

An ink cartridge 1 in a preferred embodiment according to the present invention will be described with reference to FIGS. 2A to 9C.

Figure 2A:
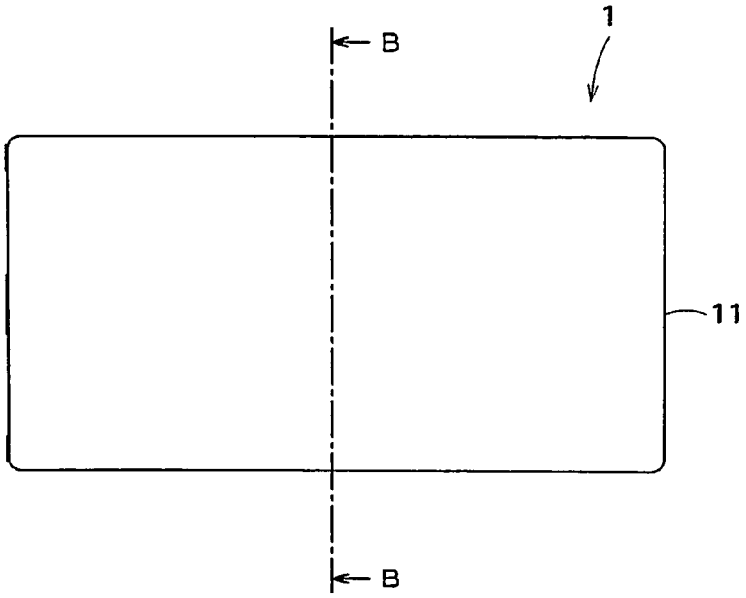
FIGS. 2A, 2B, and 2C are a side elevation, a sectional view taken on the line B-B in FIG. 2A, and a side elevation of an essential part of a container body, respectively, of the ink cartridge in the preferred embodiment.
Figure 2B:
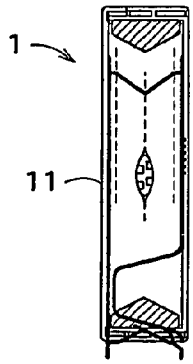
Figure 2C:
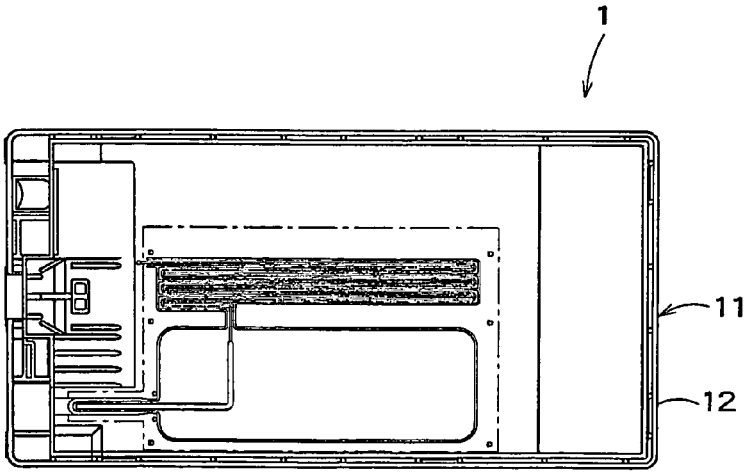
Figure 3:
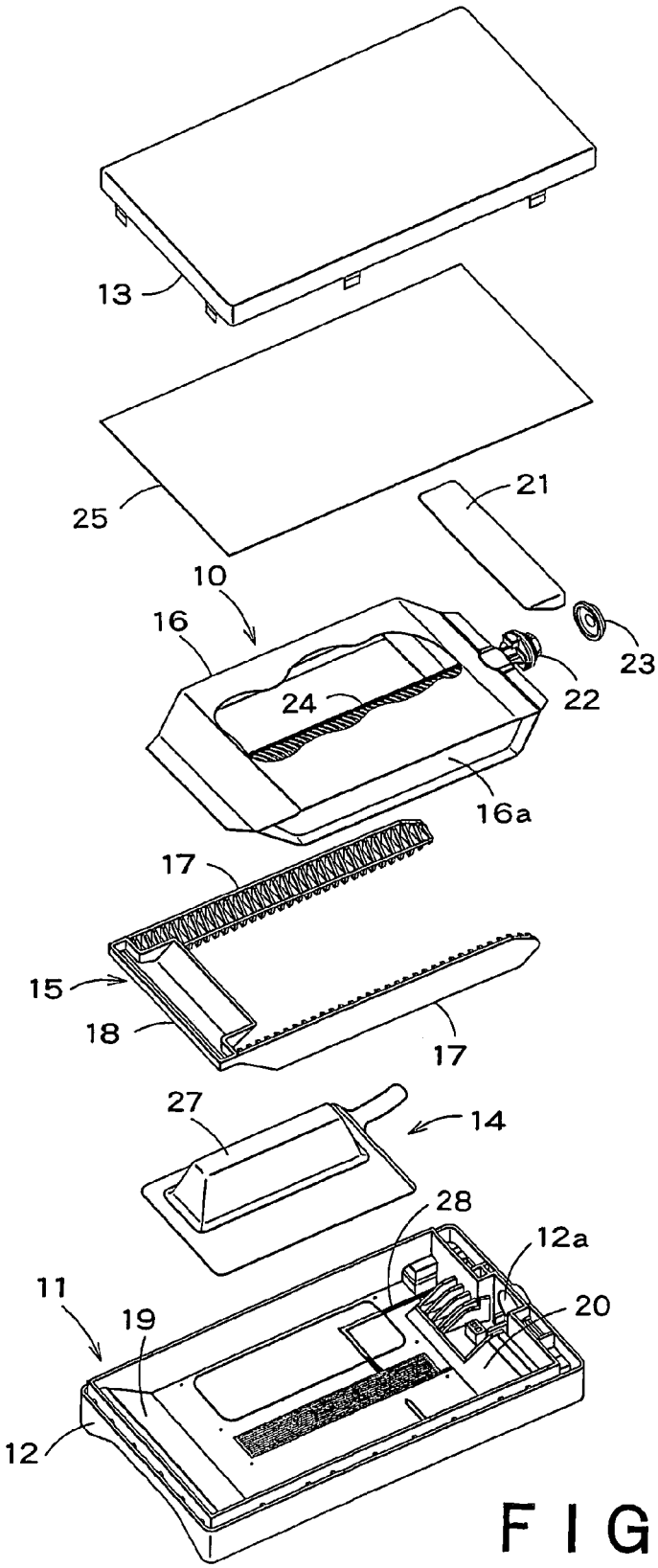
FIG. 3 is an exploded perspective view of the ink cartridge shown in FIGS. 2A to 2C.
Figure 4:
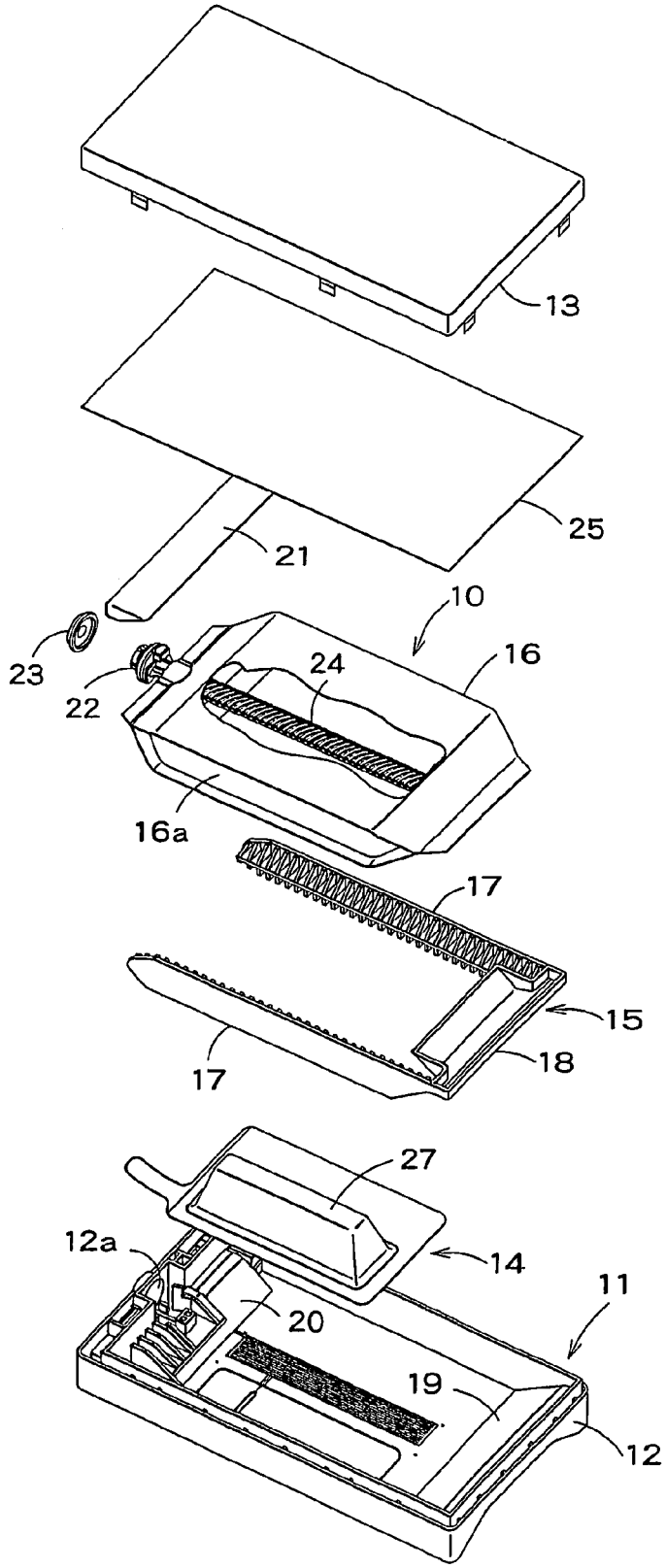
FIG. 4 is an exploded perspective view of the ink cartridge shown in FIGS. 2A to 2C, taken from a direction different from that from which the exploded perspective view shown in FIG. 3 is taken.

The ink cartridge 1 includes a container body 11 having the shape of a rectangular solid as shown in FIGS. 2A to 2C. As shown in FIGS. 3 and 4, the container body 11 has a main member 12 having one open side, and a cover 13 for hermetically covering the open side of the main member 12.

A formed film member 14 is attached to the inner surface of the main member 12. The formed film member 14 is formed of a film and has a solid part of a solid part of a predetermined three-dimensional shape and a flat part of a predetermined planar shape. A U-shaped member 15 substantially resembling the letter U and an ink pack 10 are contained in the container body 11. The ink pack 10 includes a flexible pouch 16 holding the ink.

Figure 8A:
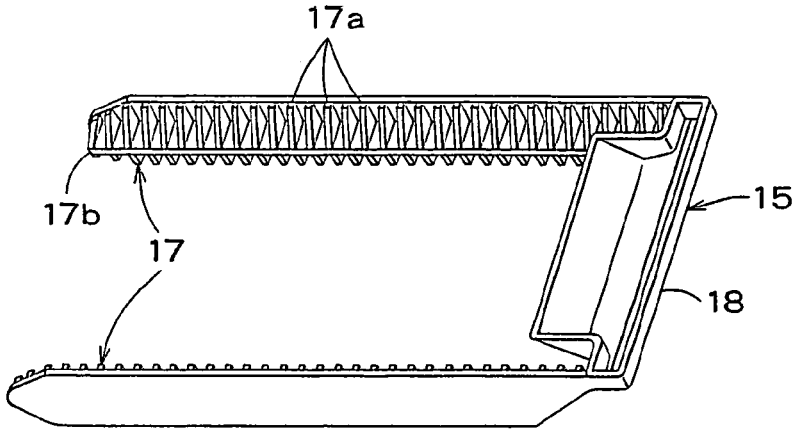
FIGS. 8A, 8B, and 8C are views of a U-shaped member included in the ink cartridge shown in FIGS. 2A to 2C, taken from different angles, respectively.
Figure 8B:
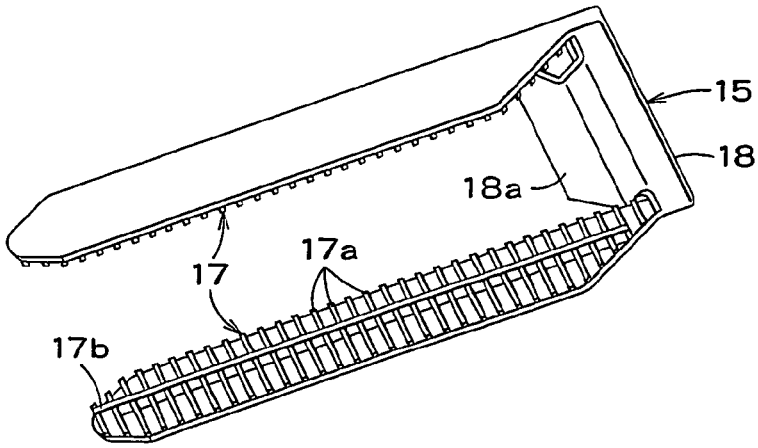
Figure 8C:
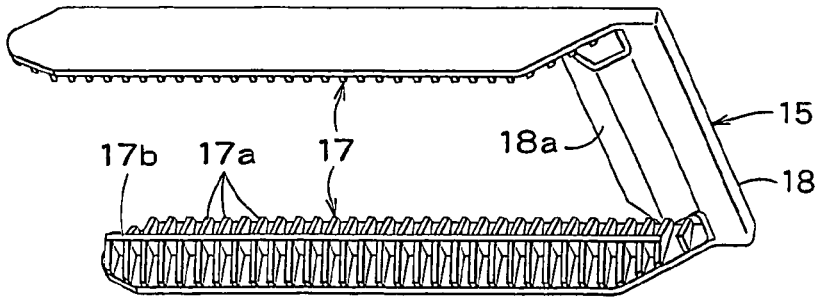

As shown in FIGS. 8A to 8C, the U-shaped member 15 has a pair of restricting parts 17 and a holding cross bar 18 having opposite ends connected to the restricting parts 17. The restricting parts 17 are in contact with bent walls 16*a* (FIGS. 3 and 4), which bend as the ink contained in the ink pack 10 is consumed, of the flexible pouch 16 to restrict the bent walls 16*a* from bending outward and to make the bent walls 16*a* bend inward. The restricting parts 17 extend substantially along the overall length of the flexible pouch 16 of the ink pack 10 in the back-and-forth direction.

Figure 6A:
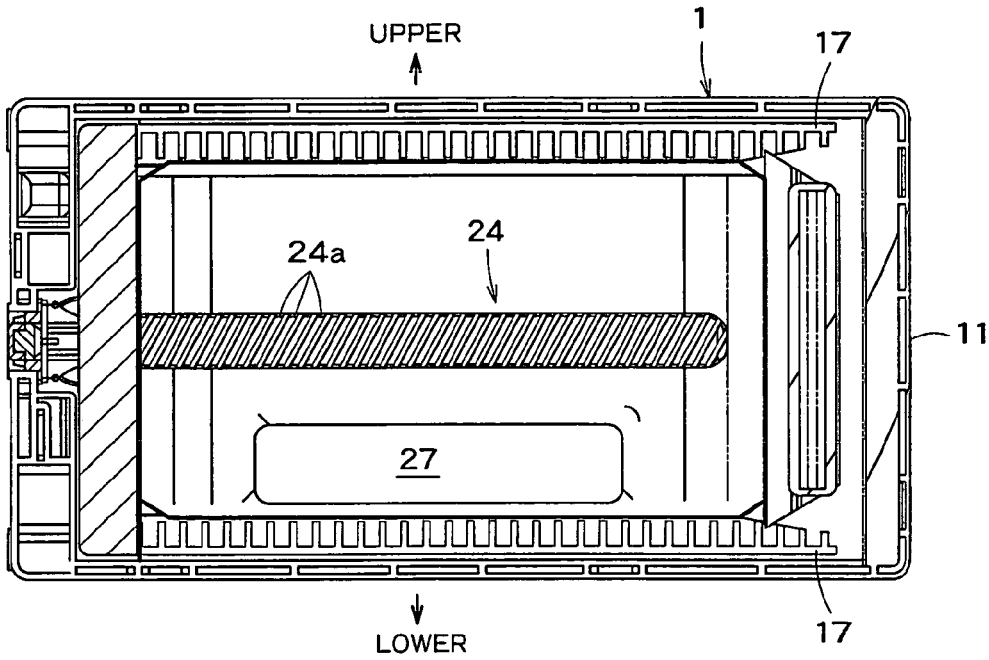
FIGS. 6A, 6B, and 6C are a vertical sectional view, a sectional plan view of a section in a plane including a spout, and a sectional plan view of a stirring chamber in an expanded state, respectively, of the ink cartridge shown in FIGS. 2A to 2C.
Figure 6B:
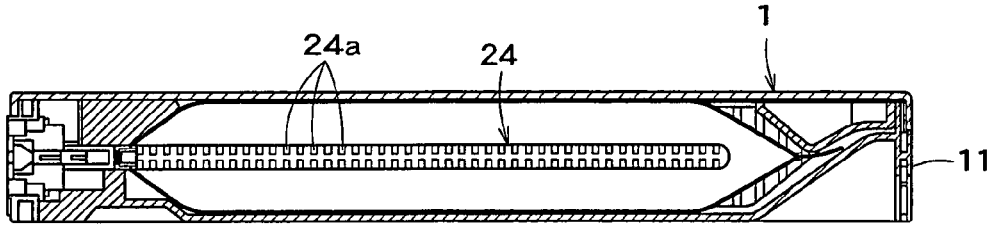
Figure 6C:
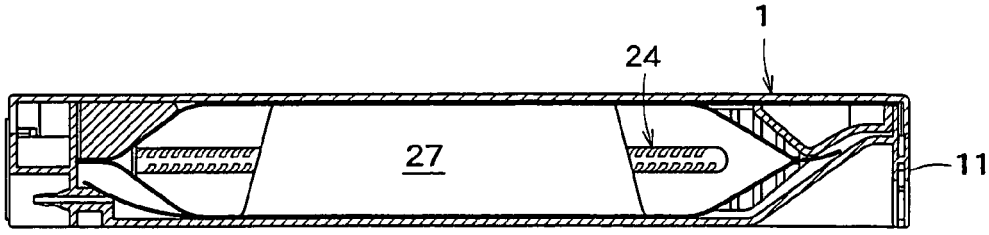
Figure 7:
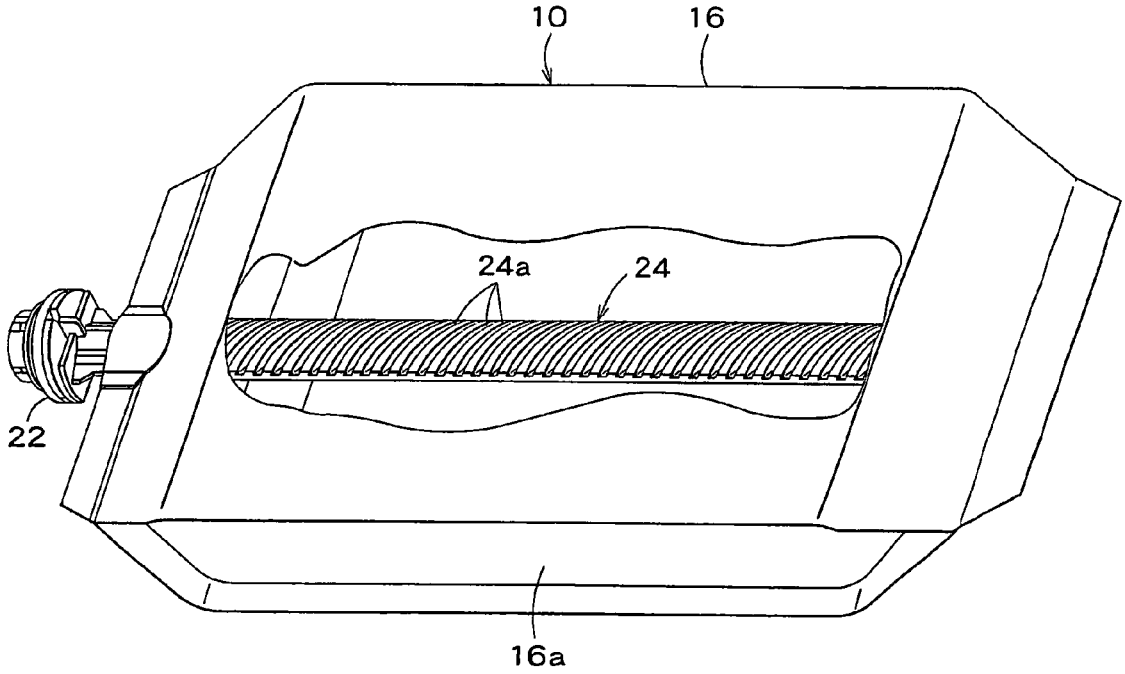
FIG. 7 is partly cutaway perspective view of an ink pack included in the ink cartridge shown in FIGS. 2A to 2C.
Figures 9A, 9B, 9C:
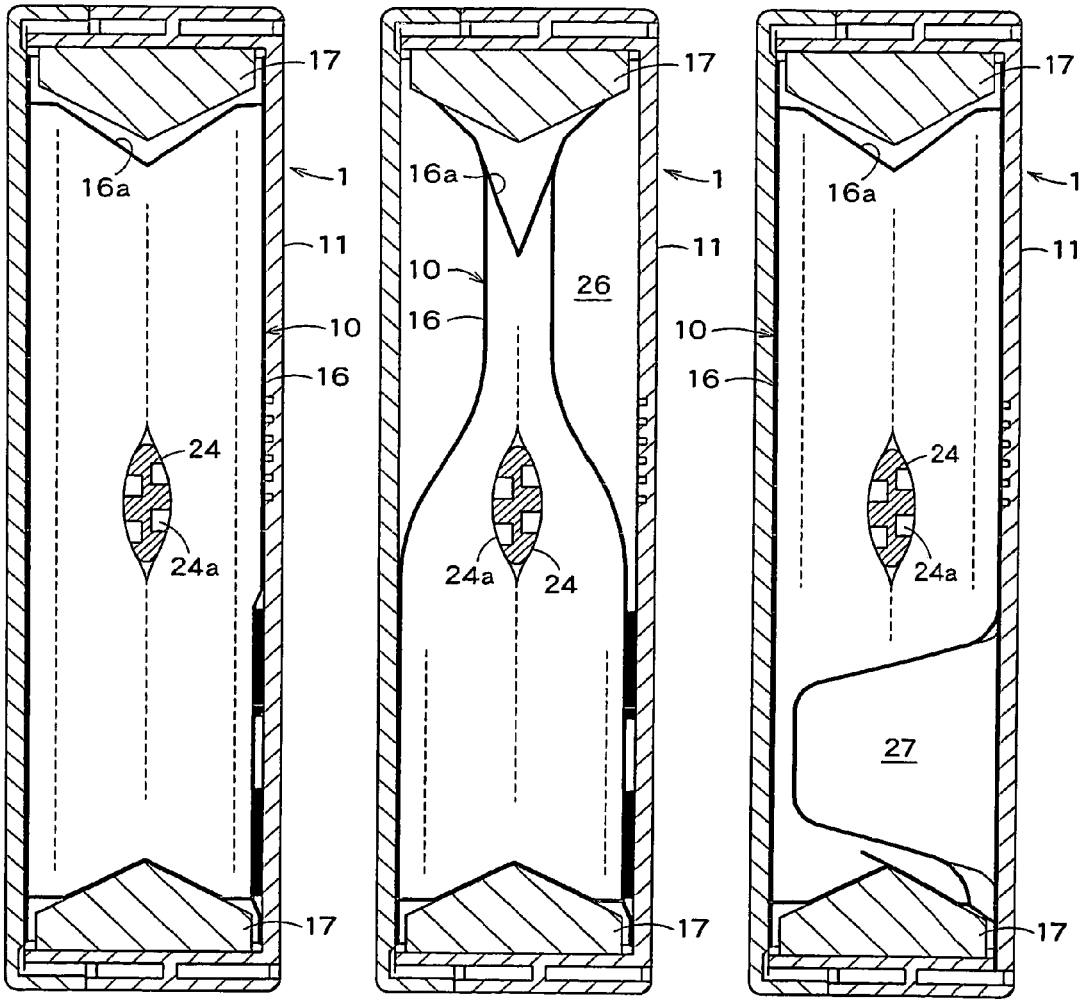
FIGS. 9A, 9B, and 9C are sectional views of the ink cartridge shown in FIGS. 2A to 2C in a state where the ink cartridge is full filled with the ink, a state where the ink cartridge is not pressed and the ink is being consumed, and a state where the ink cartridge is pressed and the ink is being consumed, respectively.

As shown in FIGS. 6A and 9C, each of the restricting parts 17 has a width substantially corresponding to the thickness of an interior space in the container body 11, and has a length substantially corresponding to the overall length of the container body 11 in the back-and-forth direction. As shown in FIGS. 8A to 8C, each restricting part 17 is provided with a plurality of triangular ribs (transverse contact parts) 17*a*, and a longitudinal, straight rib (longitudinal contact part) 17*b*. The triangular ribs 17*a* come into linear contact with the bent wall 16*a* of the flexible pouch 16 of the ink pack 10 over the entire thickness of the flexible pouch 16. The longitudinal, straight rib 17*b* comes into linear contact with the bent wall 16*a* of the flexible pouch 16 along a straight line in the back-and-forth direction of the ink pack 10.

Referring FIGS. 3 and 4, a holding slope 19 is formed in the back end of the space in the main member 12. A tapered back end part of the flexible pouch 16 of the ink pack 10 is held between the holding slope 19 and a sloping part 18*a* (FIGS. 8A to 8C) of the holding cross bar 18 of the U-shaped member 15 to secure a back part of the ink pack 10. A holding slope 20 is formed in the front end of the space in the main member 12. A tapered front end part of the flexible pouch 16 of the ink pack 10 is held between the holding slope 20 and the sloping surface of a front holding member 21 disposed in a front part of the space in the container body 11 to secure a front part of the ink pack 10.

As shown in FIGS. 3 and 4, a spout 22 is attached to the front end of the flexible pouch 16. The spout 22 is fitted in an opening 12*a* formed in the front wall of the main member 12 of the container body 11. A gap between the spout 22 and the side surface of the opening 12*a* is sealed by a sealing member 23. The ink contained in the ink pack 10 is sent out through the spout 22.

Figure 5A:
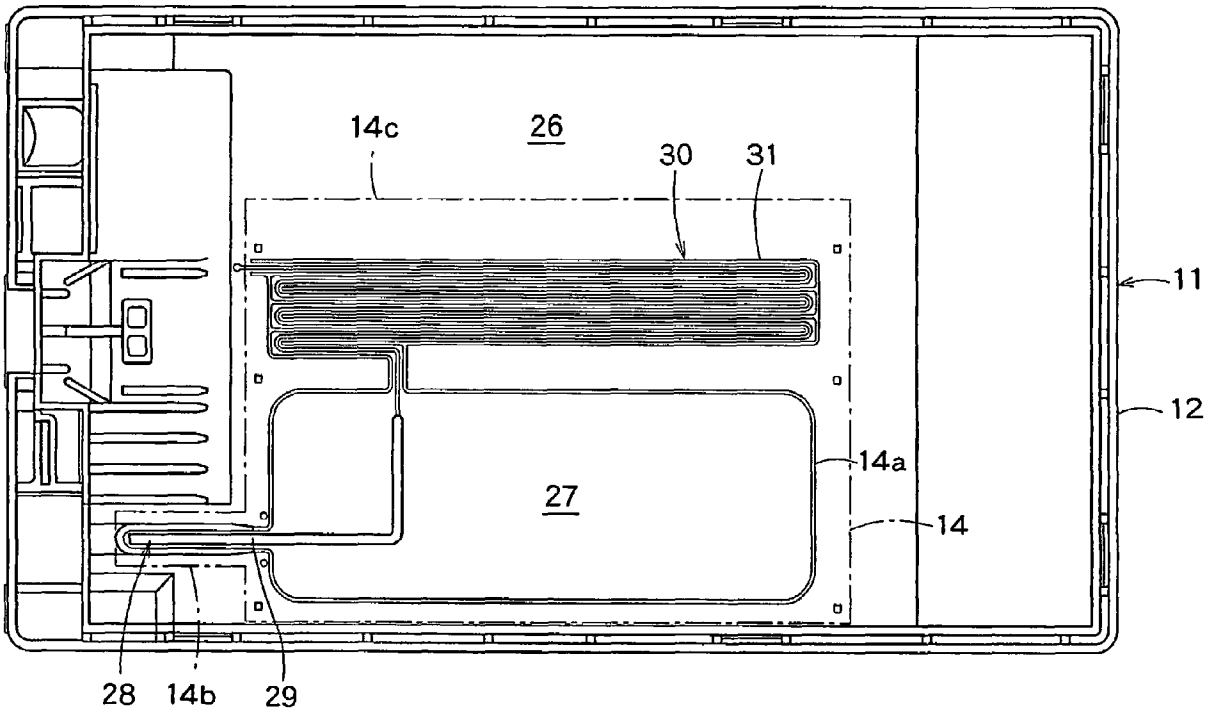
FIGS. 5A and 5B are an enlarged side elevation of an essential part of the container body of the ink cartridge shown in FIGS. 2A to 2C, and a plan view of a section in a plane including a compressed air supply passage, respectively.
Figure 5B:
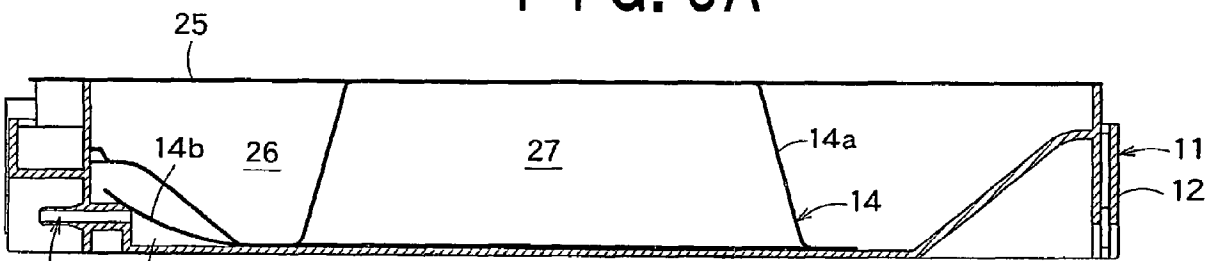

The open side of the main member 12 is hermetically covered with a film 25 to form a pressure chamber 26 in the container body 11 as shown in FIGS. 5A and 5B. The recording apparatus supplies compressed air into the pressure chamber 26 to compress the flexible pouch 16 of the ink pack 10 to deliver the ink held in the ink pack 10 to the recording apparatus.

As shown in FIGS. 5A and 5B, a protrusion (low-rigidity member) 14*a* of the formed film member 14 defines an expandable-and-contractile stirring chamber 27 in the pressure chamber 26. A compressed air supply passage 28 is formed to extend from an outer wall surface of the container body 11 to the inside thereof, so as to supply compressed air into the stirring chamber 27. A part of the compressed air supply passage 28 is formed by sealing a groove 29 formed in the inner surface of a wall of the main member 12 of the container body 11 with a projecting part 14*b* of the formed film member 14.

The stirring chamber 27 communicates with the pressure chamber 26*b* means of an open passage 30. The open passage 30 is formed by sealing a groove 31 formed in the inner surface of the wall of the main member 12 of the container body 11 with a flat part 14*c* of the formed film member 14. The groove 31 forming the open passage 30 exerts a resistance against the flow of compressed air supplied into the stirring chamber 27 so that a pressure capable of compressing and deforming the flexible pouch 16 of the ink pack 10 is generated in the stirring chamber 27. More specifically, the groove 31 forming the open passage 30 has narrow width, and is formed like a labyrinth as shown in FIG. 5A. Thus, resistance exerted by the open passage 30 against the flow of the compressed air is higher than that exerted by the compressed air supply passage 28 against the flow of the compressed air.

As shown in FIG. 5A, compressed air can be surely supplied into the stirring chamber 27 through the compressed air supply passage 28 in a state where the stirring chamber 27 is fully compressed by the ink pack 10 full filled up with the ink, because the groove 29 defining the compressed air supply passage 28 is connected to the entrance of the open passage 30 in the stirring chamber 27.

Referring FIGS. 6A to 6C and FIG. 7, a stirring bar 24 is placed in the flexible pouch 16 of the ink pack 10, and the front end of the stirring bar 24 is fixed to the spout 22. The stirring bar 24 is provided with many slant grooves 24*a* to enhance the stirring effect of the stirring bar 24. As shown in FIG. 6A, the stirring chamber 27 is disposed in a lower part of the container body 11 so as to press a lower part, with respect to a direction in which gravity acts, of the flexible pouch 16 of the ink pack 10 while the ink cartridge 1 is in use. The stirring bar 24 is disposed near and above a part, which is to be deformed due to the deformation of the stirring chamber 27, of the flexible pouch of the ink pack 10.

Functions of the ink cartridge 1 in this embodiment will be described with reference to FIGS. 9A to 9C.

FIG. 9A shows the ink pack 10 full filled with the ink of a new ink cartridge 1. When the ink pack 10 is fully filled with the ink, the ink pack 10 maintains the same shape both in a pressurized state where compressed air is supplied into the container body 11, and an unpressurized state where compressed air is not supplied into the container body 11.

From the state shown in FIG. 9A, as the ink is consumed and the quantity of the ink contained in the ink pack 10 decreases, the thickness of an upper part of the flexible pouch 16 of the ink pack 10 decreases as shown in FIG. 9B where no compressed air is supplied into the container body 11.

When the pressurizing pump 109 is actuated to supply compressed air through the compressed air supply passage 28 into the stirring chamber 27 in a state shown in FIG. 9B, the stirring chamber 27 expands so as to bulge out toward the flexible pouch 16 of the ink pack 10 as shown in FIG. 9C. Consequently, a lower part of the flexible pouch 16 of the ink pack 10 is pressed and partially deformed, and the ink contained in the flexible pouch 16 is caused to flow and is stirred. The stirring bar 24 disposed near and above the part of the flexible pouch 16 deformed by the expanded stirring chamber 27 disturbs the flow of the ink in the flexible pouch 16 to enhance the stirring effect of the flow of the ink.

The compressed air supplied into the stirring chamber 27 flows through the open passage 30 into the pressure chamber 26. Consequently, the flexible pouch 16 of the ink pack 10 is compressed and the ink can be urged to flow from the ink cartridge 1 toward the recording apparatus.

Thus, at the start of the printing operation of the recording apparatus, the stirring chamber 27 is expanded to carry out an automatic stirring operation for stirring the ink contained in the flexible pouch 16, before the flexible pouch 16 of the ink pack 10 of the ink cartridge 1 in this embodiment is compressed to supply the ink to the recording apparatus. Since compressed air is not supplied to the stirring chamber 27 while the recording apparatus is not in operation, unnecessary compression of the flexible pouch 16 of the ink pack 10 can be avoided while the recording apparatus is not in operation. The construction of the recording apparatus can be simplified by using a common pressure source for both pressing the ink pack 10 and expanding the stirring chamber 27.

The stirring operation by the expansion of the stirring chamber 27 may be performed not only at the start of the printing operations, but also at any suitable time when necessary.

The pressurizing pump 109 may be capable of alternately performing a discharge operation and a suction operation to make the stirring chamber 27 perform expansion and contraction alternately.

As apparent from the foregoing description, when the upper bent wall 16*a* of the flexible pouch 16 of the ink pack 10 bends (FIG. 9B) with a consumption of the ink contained in the ink pack 10, the restricting part 17 restricts the bending direction of the upper bent wall 16*a* so that the upper bent wall 16*a* can surely bend inward. Thus, it is possible to prevent the outward bending of the bent wall 16*a* of the flexible pouch 16 and resultant increase in resistance against the bending of the bent wall 16*a*, and increase in the quantity of the ink that is unused and remains in the ink pack 10.

Since the triangular ribs 17*a* forming the restricting part 17 are in contact with the bent wall 16*a* over the entire thickness of the flexible pouch 16 of the ink pack 10, the concentration of impulsive force on the folding line of the bent wall 16*a* can be avoided when the flexible pouch 16 of the ink pack 10 is compressed. In addition, the restricting parts 17 are able to hold the ink pack 10 securely in place in the container body 11.

Particularly, in the ink cartridge 1 in this embodiment, the bent walls 16*a* of the flexible pouch 16 of the ink pack 10 are pressed against the restricting parts 17 when the stirring chamber 27 is expanded for a stirring operation. It is very effective to avoid the concentrated, repetitive application of impulsive force on the bent walls 16*a*.

Unification of the restricting parts 17 and the holding cross bar 18 in a single member can reduce the number of parts.

The ink cartridge 1 in this embodiment is capable of surely preventing an uneven distribution of ingredient concentration in the ink contained therein without intensifying the structural complicacy of the ink-jet recording apparatus and without enlarging the ink-jet recording apparatus. When a pigment ink is used for printing, the ink cartridge 1 is particularly effective in preventing the uneven sedimentation of the pigment particles in the ink cartridge 1.

The flexible pouch 16 of the ink pack 10 of the ink cartridge 1 in this embodiment is compressed by compressed air when the recording apparatus operates for printing. However, an ink cartridge provided with an ink pack that is not compressed when the recording apparatus operates for printing may be provided with the foregoing stirring mechanism and restricting parts.

An ink cartridge in a first modification of the ink cartridge 1 in the preferred embodiment will be described with reference to FIG. 10.

Figure 10:
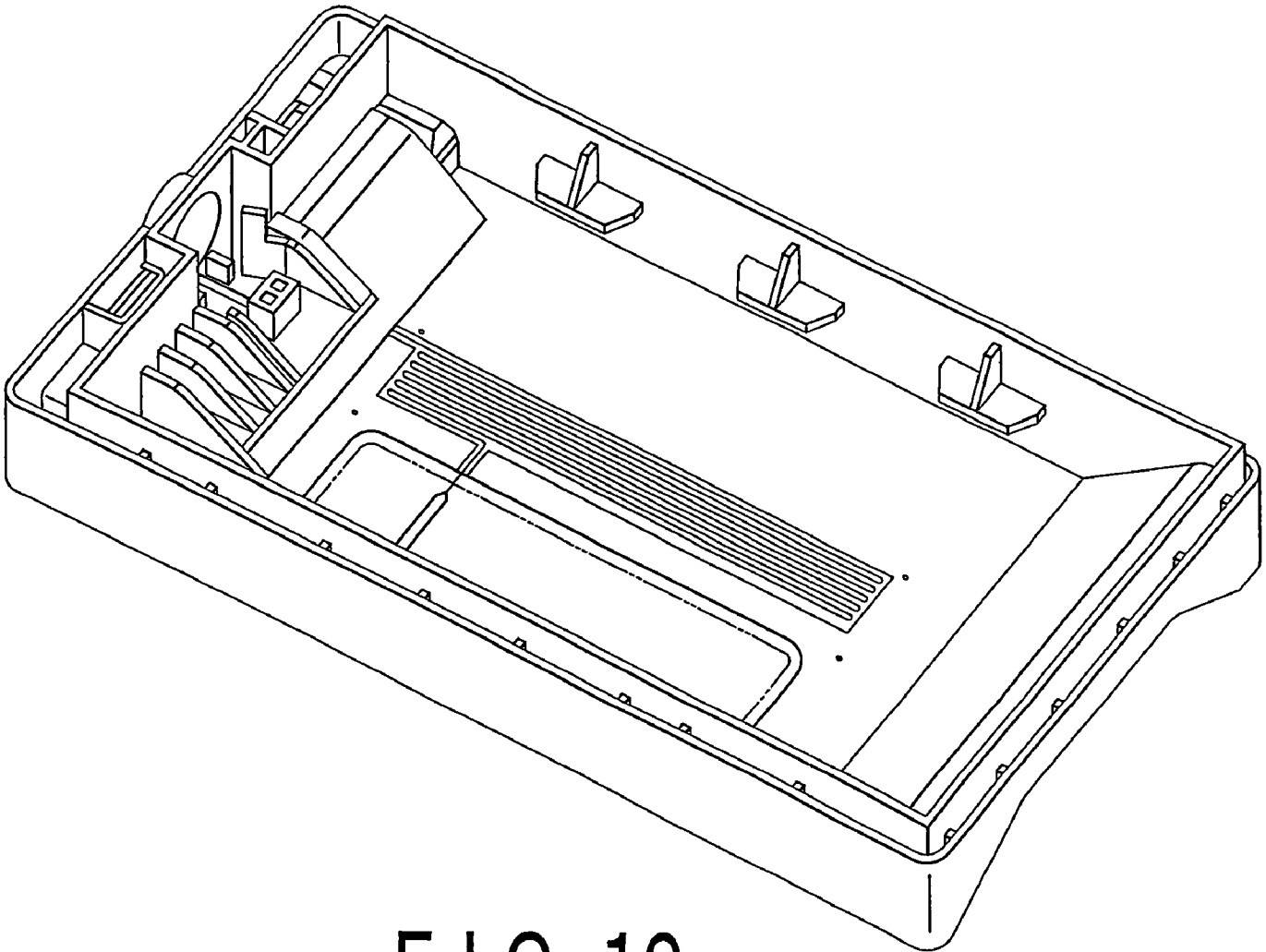
FIG. 10 is a perspective view of an essential part of a container body included in an ink cartridge in a modification of the ink cartridge shown in FIGS. 2A to 2C.
Figure 11:
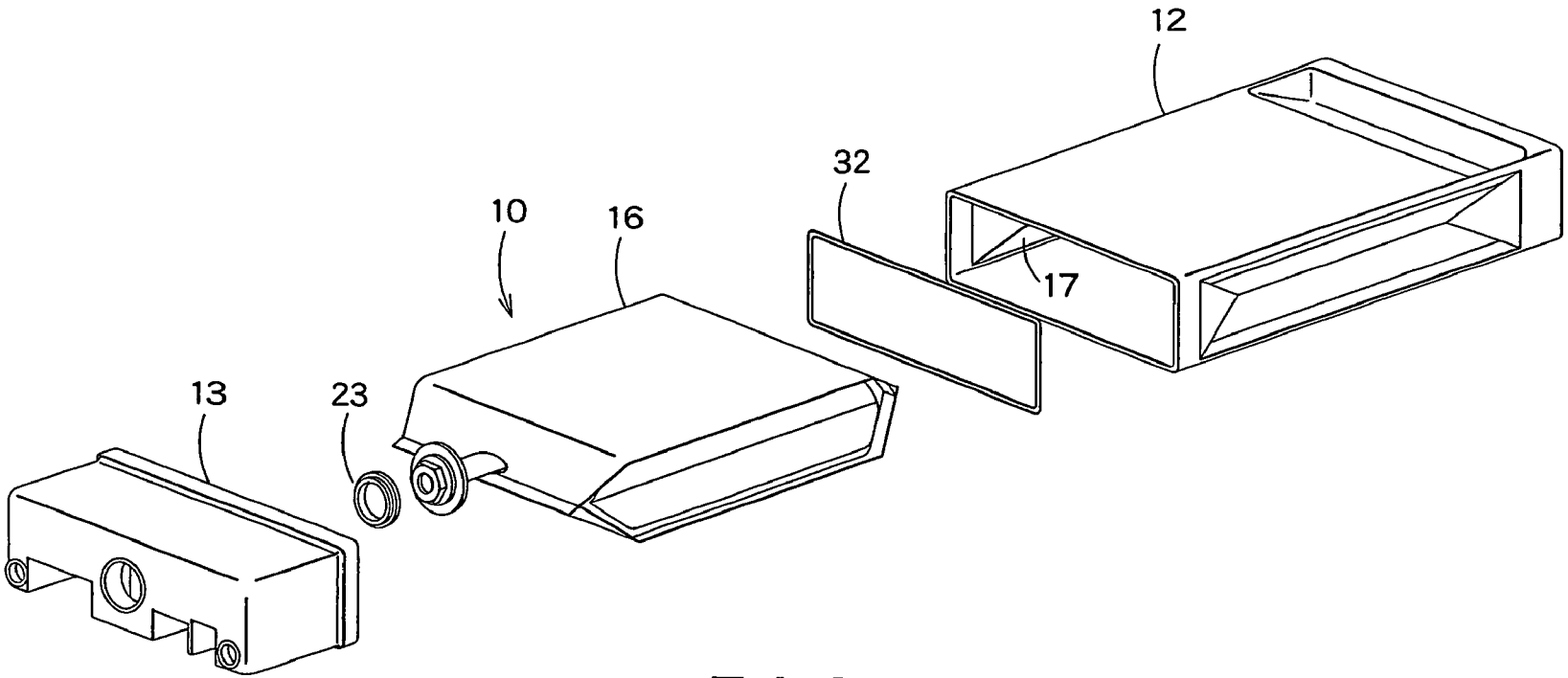
FIG. 11 is an exploded perspective view of an ink cartridge in another modification of the ink cartridge shown in FIGS. 2A to 2C.
Figure 12A:
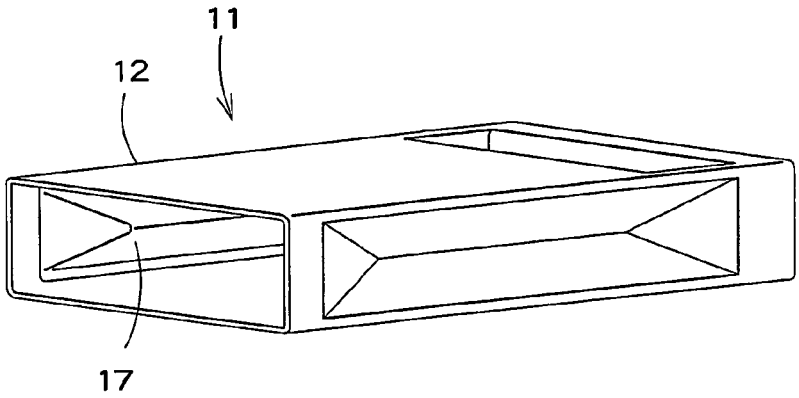
FIGS. 12A, 12B, and 12C are a perspective view, a side elevation, and a sectional view taken on the line A-A in FIG. 12B, respectively, of an essential part of the container body of the ink cartridge shown in FIG. 11.
Figure 12B:
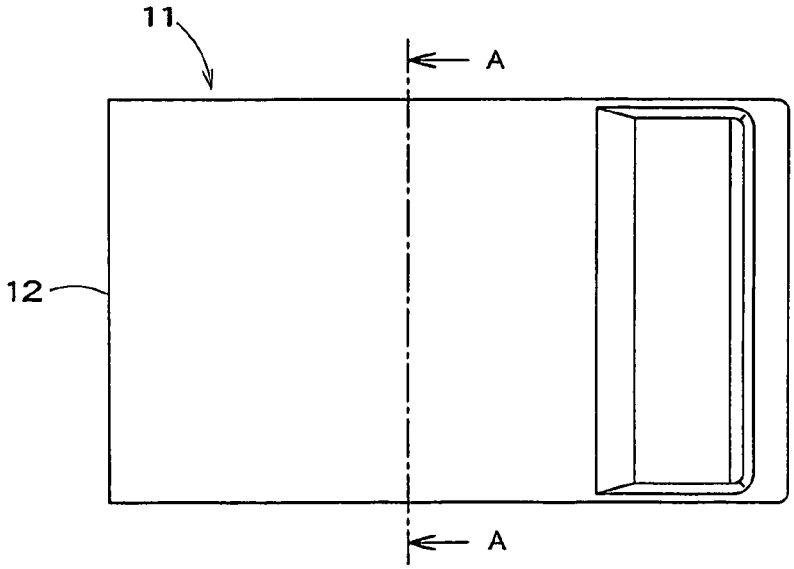
Figure 12C:
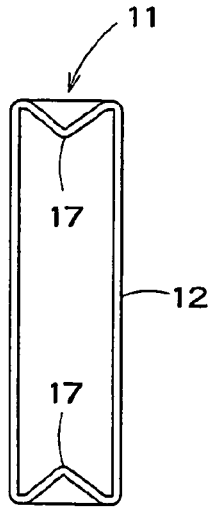
Figure 13A:
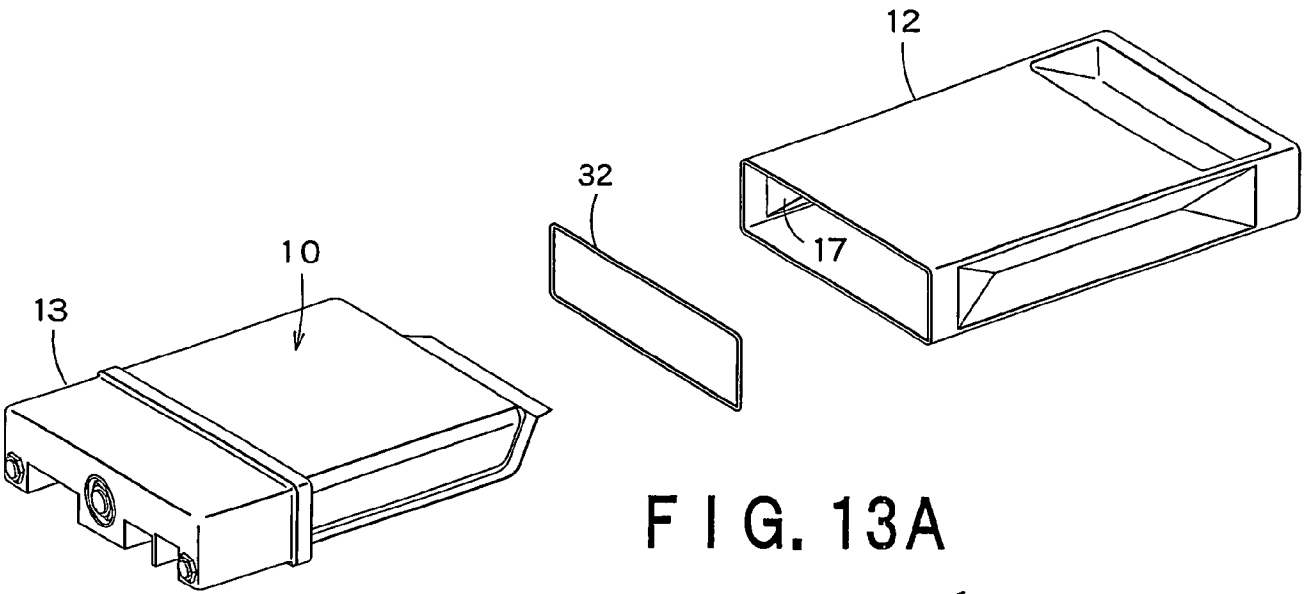
FIGS. 13A and 13B are perspective view of the ink cartridge shown in FIG. 11 in a state where the ink cartridge is being assembled, and a state where the ink cartridge is completed, respectively.
Figure 13B:
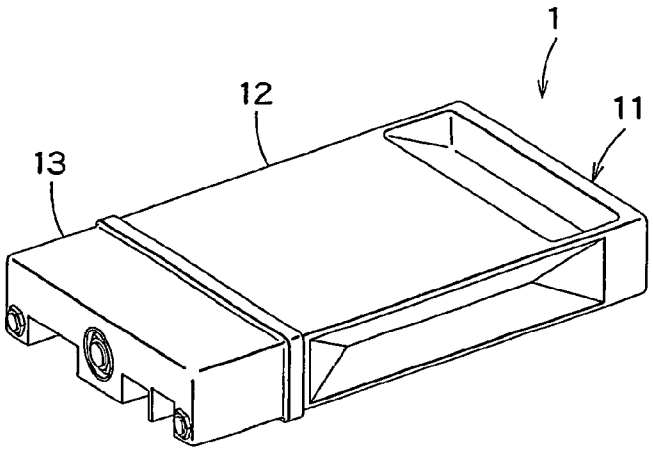

As shown in FIG. 10, restricting parts 17 are formed integrally with a container body 11. The restricting parts 17 are formed on the inner surface of a main member 12 included in the container body 11 at intervals along the length of an ink pack 10 in the back-and-forth direction. The restricting parts 17 are in contact with the bent wall 16*a* over substantially the entire thickness of the flexible pouch 16 of the ink pack 10.

The ink cartridge in the first modification is expected to have the same effect as that of the foregoing embodiment. Moreover, since the restricting parts 17 are formed integrally with the container body 11, the number of parts can be reduced and manufacturing processes can be simplified.

Referring to FIGS. 11 to 13B showing an ink cartridge in a second modification, a container body 11 includes a main member 12 having an open front end, and a cover 13 hermetically covering the open front end of the main member 12. An O-ring 32 is held between the main member 12 and the cover 13 to seal the container body 11. The second modification does not need any member corresponding to the film 25 showing in FIGS. 3 and 4.

The upper and lower walls of the main member 12 of the ink cartridge in the second modification are bent inward so as to protrude into the interior of the main member 12 to form restricting parts 17 having a triangular cross section.

The ink cartridge in the second modification is expected to have the same effect as that of the foregoing embodiment. Moreover, since the ink cartridge in the second modification does not need any members corresponding to the film 25 and the restricting parts 17 separate from the main member 12 shown in FIGS. 3 and 4, the number of parts can be reduced and manufacturing processes can be simplified.

Although the invention has been described in terms of the preferred embodiments thereof with a certain degree of particularity, obviously many changes and variations are possible therein. It is therefore to be understood that the present invention may be practiced otherwise than as specifically described herein without departing from the scope and spirit thereof.

What is claimed is:

1. A liquid container holding a liquid to be supplied to a liquid-consuming apparatus, comprising:

a liquid pack including a flexible pouch formed of a flexible material and holding the liquid, the flexible pouch having a bending wall which bends with a consumption of the liquid held in the flexible pouch, the bending wall having an outer surface;

a container body containing the liquid pack; and a restricting member configured to be in contact with the bending wall of the flexible pouch for restricting the bending wall of the flexible pouch from bending outward when the liquid is consumed, such that the bending wall bends inward when the liquid is consumed;

wherein the restricting member is adapted to be in contact with the outer side surface of the bending wall over substantially an entire thickness of the flexible pouch of the liquid pack.

2. The liquid container according to claim 1, wherein the restricting member has a width substantially corresponding to an entire thickness of an interior space in the container body.

3. The liquid container according to claim 1, wherein the restricting member has a length substantially corresponding to an overall length of the flexible pouch of the liquid pack in a back-and-forth direction.

4. The liquid container according to claim 1, wherein the restricting member includes a plurality of restricting members which are disposed at intervals along a length of the flexible pouch of the liquid pack in a back-and-forth direction.

5. The liquid container according to claim 1, wherein the restricting member includes a rib configured to be in linear contact with the bending wall along the thickness of the flexible pouch of the liquid pack.

6. The liquid container according to claim 1, wherein the restricting member includes a transverse contact part configured to be in contact with the bending wall over substantially the entire thickness of the flexible pouch of the liquid pack, and a longitudinal contact part configured to be in linear contact with the bending wall along a length of the flexible pouch of the liquid pack in a back-and-forth direction.

7. The liquid container according to claim 1, wherein the restricting member has a substantially triangular cross section projecting toward the bending wall of the flexible pouch.

8. The liquid container according to claim 1 further comprising a holding member for securing the liquid pack in the container body, wherein the restricting member is formed integrally with the holding member.

9. The liquid container according to claim 1, wherein the restricting member is formed integrally with the container body.

10. The liquid container according to claim 1, wherein the container body includes a main member having an open front end, and a cover hermetically covering the open front end of the main member.

11. The liquid container according to claim 1, wherein the liquid is discharged by compressing the flexible pouch of the liquid pack by pressure of a pressurized fluid supplied into the container body.

12. The liquid container according to claim 1 further comprising an expandable-and-contractile stirring chamber formed in the container body, wherein pressurized fluid is supplied into the stirring chamber to expand the stirring chamber so that the flexible pouch of the liquid pack is pressed and deformed to stir the liquid contained in the liquid pack.

* * * * *